US008061058B2

(12) United States Patent
Harpenau

(10) Patent No.: US 8,061,058 B2
(45) Date of Patent: Nov. 22, 2011

(54) REMOTE RESTRICTION DETECTING SYSTEM FOR CLOTHES DRYER EXHAUST SYSTEMS

(76) Inventor: Richard J. Harpenau, Jupiter, FL (US)

( * ) Notice: Subject to any disclaimer, the term of this patent is extended or adjusted under 35 U.S.C. 154(b) by 897 days.

(21) Appl. No.: 12/099,207

(22) Filed: Apr. 8, 2008

(65) Prior Publication Data

US 2009/0249643 A1 Oct. 8, 2009

(51) Int. Cl.
*F26B 13/10* (2006.01)

(52) U.S. Cl. ..... 34/558; 34/88; 34/89; 34/140

(58) Field of Classification Search ..... 34/524, 34/558, 88, 89, 140
See application file for complete search history.

(56) References Cited

U.S. PATENT DOCUMENTS 6,785,981 B1 * 9/2004 Harpenau ..... 34/140

FOREIGN PATENT DOCUMENTS

DE 3805815 A * 9/1989

* cited by examiner

*Primary Examiner* — Jiping Lu
(74) *Attorney, Agent, or Firm* — Akerman Senterfitt

(57) ABSTRACT

A restriction sensor system for identifying the existence of blockages in exhaust conduits of clothes dryers. The restriction sensor system may be used as a retrofit system that is capable of being installed on existing clothes dryers. The restriction sensor system may include a fitting configured to be coupled to an exhaust conduit of a clothes dryer and a blockage indicator housing positioned remote from a clothes dryer. The pressure sensing device may be capable of determining changes in air pressure in the exhaust conduit. Once the air pressure present in the exhaust conduit exceeds a threshold air pressure, the pressure sensing device may send a signal to an indicator to generate an alarm, which may be a visual alarm or audible alarm, or both.

17 Claims, 5 Drawing Sheets

REMOTE RESTRICTION DETECTING SYSTEM FOR CLOTHES DRYER EXHAUST SYSTEMS

FIELD OF THE INVENTION

This disclosure is directed generally to clothes dryers, and more particularly, to safety systems for clothes dryers.

BACKGROUND

Conventional clothes dryers are constructed of a tumbler configured to hold clothes, a motor for rotating the tumbler, a heating element for heating air, a fan for blowing the heated air across the clothes while the clothes are in the tumbler, and an exhaust conduit for venting the heated air from the dryer. The heating element may be electric or gas powered. Because a clothes dryer includes a heating element, a fire risk always exists.

Conventional clothes dryers include many different safety devices for reducing the likelihood of a fire, particularly if lint builds up in the dryer. For instance, a conventional clothes dryer often includes a lint screen for removing lint from the air coming from a tumbler. The lint screen is often placed in an easily accessible location, such as in a slot in a top surface of the clothes dryer, or adjacent the door of the dryer, and covers an exhaust conduit where the conduit leaves the tumbler. The lint screen collects lint from the air that has been picked up from the clothing in the tumbler. Most, if not all, manufacturers of clothes dryers recommend that lint screens be cleaned after each load of clothes is dried. Otherwise, an unacceptable amount of lint may build up on the lint screen and pose a fire hazard and prevent efficient operation. However, not all users may be conscientious about cleaning the lint screen after each use. Additionally, lint screens are typically not capable of removing all the lint from the exhaust air, and thus it is almost inevitable that some lint will enter the exhaust conduit.

Clothes dryers also typically contain heat sensors, such as thermocouples, for preventing dryers from overheating and causing fires. Most clothes dryers position a thermocouple proximate to a heating element of the clothes dryer. In this position, the thermocouple is capable of monitoring the area surrounding the heating element and can be used to determine whether the air surrounding the heating element is exceeding a predetermined threshold temperature. If the air becomes too hot, the thermocouple breaks a circuit, which thereby turns the dryer off and prevents the dryer from operating. The temperature of the air surrounding the heating element is monitored because the air surrounding the heating element often becomes too hot for safe operation when an exhaust conduit contains a blockage, for example, caused by a lint build-up. Blockages in the exhaust conduits are dangerous because the blockages can cause the heating element to overheat and ignite lint near the heating element.

A problem exists with dryers in that many exhaust hoses or conduits for clothes dryers are incorrectly installed such that the exhaust conduits have internal diameters that are too small, or are restrained by having to extend through an angle to reach an exhaust vent or are placed in a restricted location. Such configurations accelerate lint collection on inside surfaces of the exhaust conduits, which may eventually result in partial or total blockage of the exhaust conduit. Such accumulation of lint may occur relatively quickly or over a longer period, such as a few years, and may go unnoticed by a homeowner. Such conditions can be extremely dangerous.

While the conventional configuration of locating a thermocouple proximate to heating elements in a dryer has undoubtedly prevented many fires, dryers having this configuration remain susceptible to fires. Additionally, thermocouples can and do break down and become inoperable, rendering the safety device incapable of shutting down the dryer when a dangerous condition exists. In fact, dryers remain one of the most dangerous household appliances. Thus, a need exists for a system for improving the safety of clothes dryers.

SUMMARY OF THE INVENTION

This disclosure relates to a restriction sensor system usable with a clothes dryer for identifying blockages in an exhaust conduit in an effort to prevent dangerous conditions and fires. The blockages may be found in the exhaust conduit of a clothes dryer. The restriction sensor system may be configured to be retrofitted on any existing clothes dryer so that clothes dryers that are currently in use may be easily updated with this important safety device.

The restriction sensor system may be formed of an air pressure sensing system for a clothes dryer, which has a fitting having at least one cavity therethrough and which is configured to be coupled to an exhaust conduit of a clothes dryer. The fitting is configured for sampling air passing through the exhaust conduit. A blockage indicator housing may be provided, physically remote from the fitting and including at least one chamber. A pressure sensor may be contained within the at least one chamber of the blockage indicator housing remote from the fitting, with the pressure sensor in communication with the fitting for sensing pressure changes in the exhaust conduit. An indicator may be contained within the blockage indicator housing, with the indicator in communication with the pressure sensor for indicating that the pressure sensor has sensed air pressure exceeding a threshold air pressure in the exhaust conduit.

The restriction sensor system may also include one or more indicators for indicating that the pressure sensing device has identified that the air pressure in the exhaust conduit of the clothes dryer has exceeded a threshold air pressure. The indicator may be capable of generating a visual alert or an audible alert, or both. The indicator may be contained within the blockage indicator housing. These and other components are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

FIGS. 1-11 show a restriction sensor system 10 for use with an exhaust conduit 8 of a clothes dryer 2. Restriction sensor system 10 may be capable of determining whether an exhaust conduit 8 contains a blockage, which could potentially cause unsafe conditions and lead to a fire by sensing changes in pressure in the exhaust conduit 8. The exhaust conduit 8 may include portions located inside of or outside of clothes dryer 2, or both. The exhaust conduit 8 may be an aluminum flex conduit, a foil flex conduit or other appropriate conduit.

Figures 1, 3:
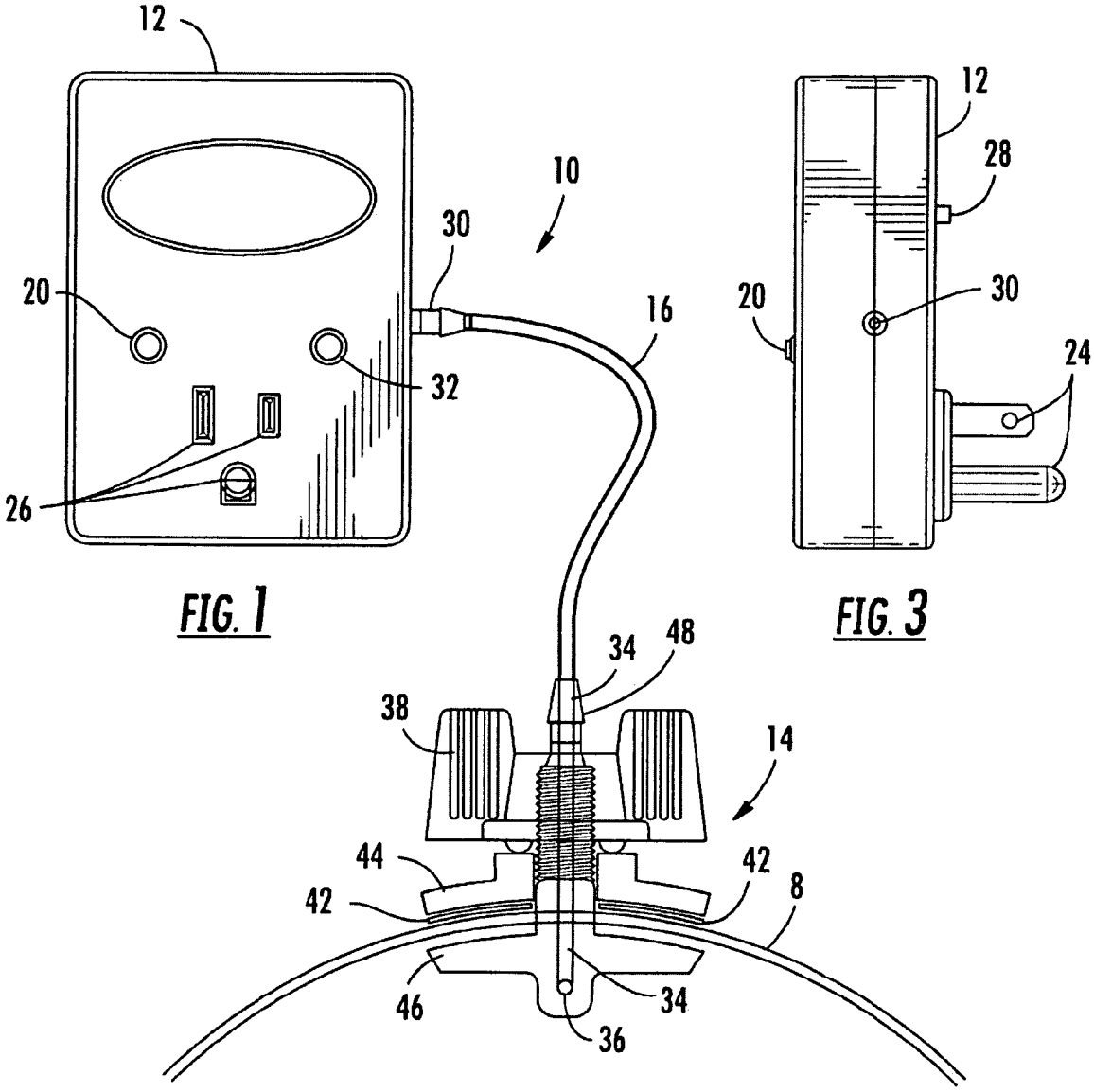
FIG. 1 is a view of a restriction sensor system according to the present invention.
FIG. 3 is a side view of the blockage indicator housing.
Figure 2:
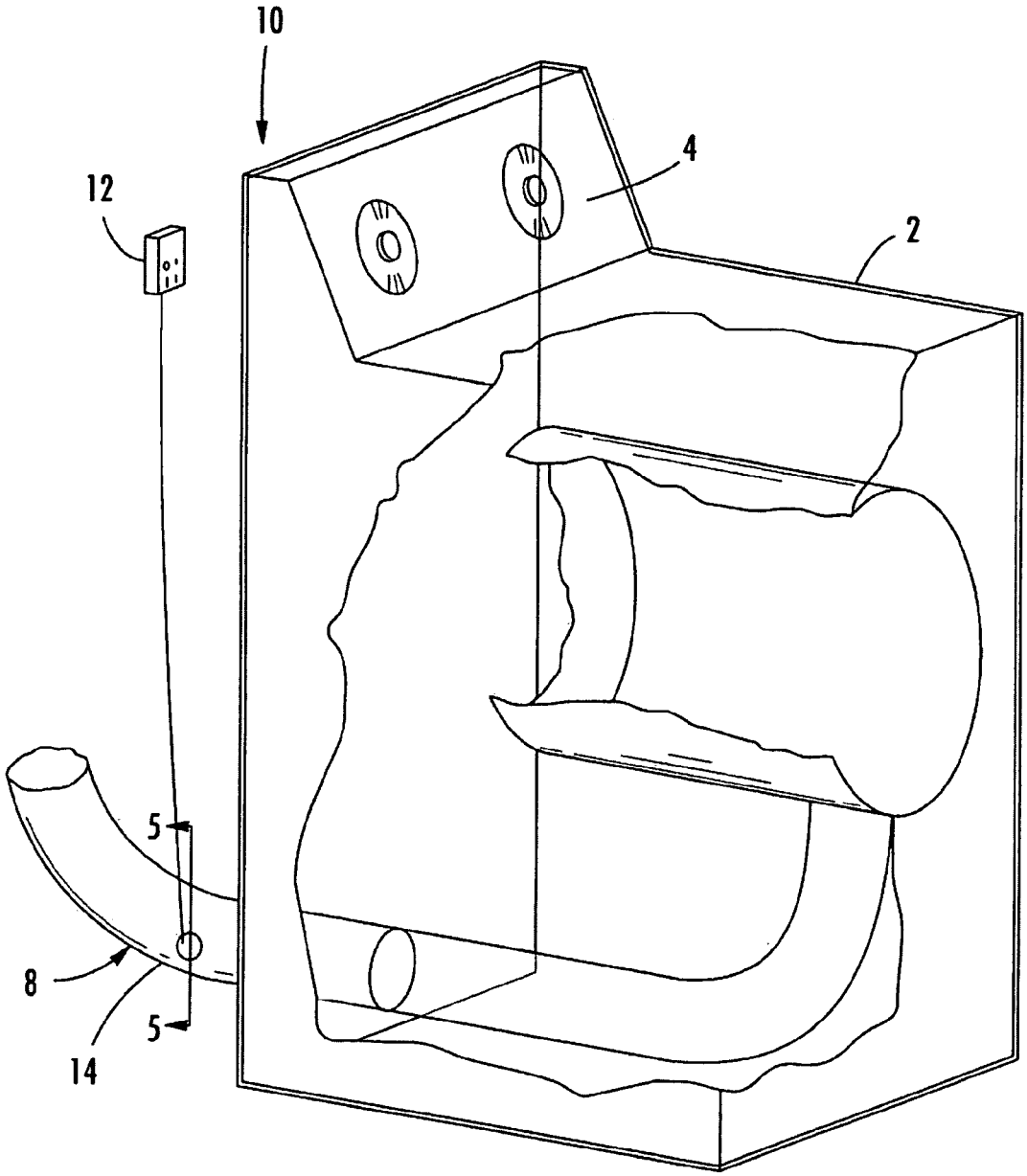
FIG. 2 is a perspective view of a clothes dryer together with the restriction sensor system of FIG. 1.
Figure 4:
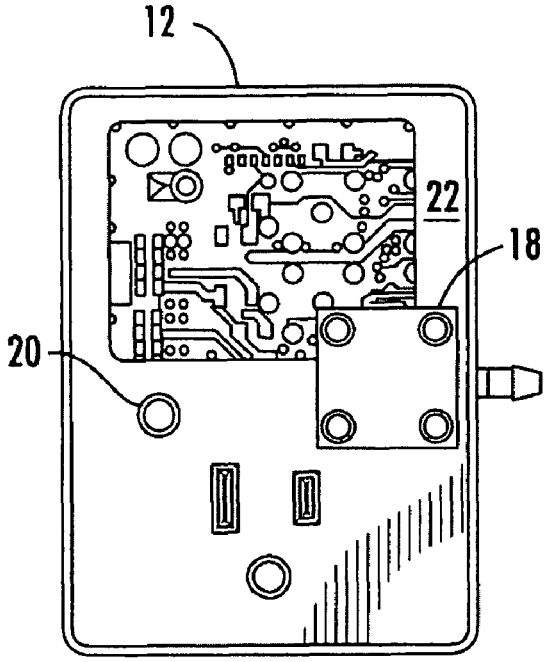
FIG. 4 is a top view of the internal chamber of the blockage indicator housing and the components contained therein.

The restriction sensor system 10 may include a blockage indicator housing 12 containing a pressure sensor 18, as shown in FIG. 4, and an indicator 20, as shown in FIG. 1, for indicating that the pressure sensor 18 has sensed an air pressure exceeding a threshold pressure in exhaust conduit 8 of clothes dryer 2. The blockage indicator housing 12 may be configured to be used together with an existing clothes dryer 2 to retrofit the clothes dryer 2 with the restriction sensor system 10. The restriction sensor system 10 may also include a fitting 14 designed to be attached to the exhaust conduit 8. The fitting 14 may be linked with the blockage indicator housing 12 by a conduit or tube 16.

The blockage indicator housing 12 may include one or more appropriately sized chambers 22 for housing the pressure sensor 18 and the indicator 20. The blockage indicator housing 12 may be designed to be a stand alone unit separate from a control panel 4 of the clothes dryer 2 and physically remote from the fitting 14 that is attached to the exhaust conduit 8. The blockage indicator housing 12 may be sized about two and a half inches wide, three and a half inches in height and a depth of about one inch, but may have any suitable size. The blockage indicator housing 12 may be configured to be positioned near the clothes dryer 2, such as attached to an electrical receptacle with a male power plug 24. The power plug 24 may be any appropriate plug. The blockage indicator housing 12 may also include a female electrical receptacle 26 on an opposite outer surface of the blockage indicator housing 8. The female electrical receptacle 26 acts as a pass through electrical source to provide other electrical devices with power in a laundry room where power outlets are often in short supply. One or more supports 28 may protrude from a rear surface of the blockage indicator housing 12 to support the blockage indicator housing 12 proximate to a wall surface. The blockage indicator housing 12 may be formed from a plastic or other appropriate material. A hollow barb or spigot 30 may protrude from blockage indicator housing 12, for example, from a side thereof, to receive conduit 16 and to provide a connection from the conduit 16 to the pressure sensor 16. A mute button 32 may also be provided.

The blockage indicator housing 12 may include the pressure sensor 18 that may be capable of determining whether the air pressure in exhaust conduit 8 has exceeded a threshold air pressure, which may indicate that a blockage exists. In one embodiment, pressure sensor 18 may be a pressure differential switch, such as available from World Magnetics, Inc. in Traverse City, Mich. Any suitable pressure differential switch or other pressure sensor may be used. The exhaust conduit 85 may be a conduit extending from an exit port of a tumbler 6 venting air from clothes dryer 2 to an outside exhaust vent.

Figure 8:
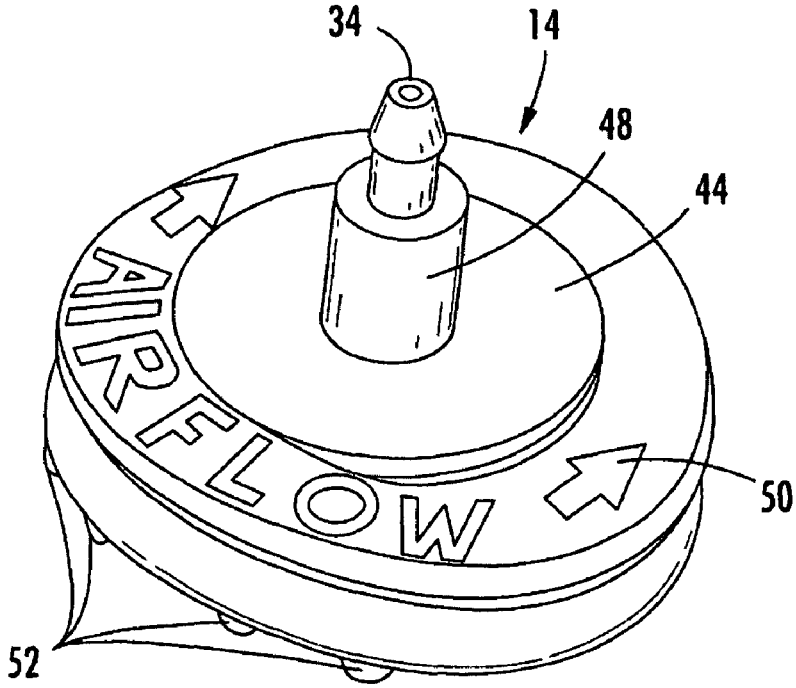
FIG. 8 is a top side perspective view of the fitting shown in FIG. 7.
Figure 9:
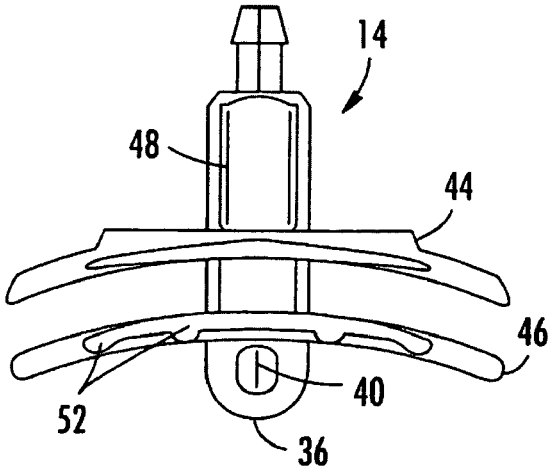
FIG. 9 is a side view of the fitting shown in FIG. 7.

The restriction sensor system 10 may include a fitting 14, as shown in FIGS. 1 and 5-10, configured to be attached to the exhaust conduit 8. The fitting 14 may contain one or more conduits 34 extending therethrough for admitting air found in exhaust conduit 8 into the conduit 16 and hence to the pressure sensor 18. The conduit 34 may have any size appropriate for admitting a gas into the conduit 16. The fitting 14 may include an air pick up with a contamination limiting foil 40. The contamination limiting foil 40 may be configured to prevent the buildup of lint within the conduit 34 and may extend either partially or fully across an opening 36 to conduit 34. In one arrangement, as shown in FIG. 9, the contamination limiting foil 40 may have a slit therein. The conduit 34 may extend from the fitting 14 such that the opening 36 of the conduit 34 is generally orthogonal to a longitudinal axis of the fitting and aligned with air flow through the conduit 34.

The fitting 14 may include two flanges 44, 46, with one flange 46 configured to fit inside the exhaust conduit and one flange 44 configured to fit on the outside of the exhaust conduit. The flanges 44, 46 may be curved to provide a snug fit on the surface of the exhaust conduit 8. A hollow barb or spigot 48 for connecting to the tube or conduit 16 may be attached or molded in one piece with either the flange 44 or the flange 46. Typically, the spigot 48 will be attached to flange 46 that is provided inside the exhaust conduit, with the conduit 34 extending through the spigot 48. As shown in FIG. 8, markings 50 may be included on an outer surface of flange 44 to indicate the correct orientation of the fitting 14 on the exhaust conduit 8 such that the opening 36 of the conduit points towards the direction of air flow. The fitting 14 may be formed from materials such as, but not limited to, nylon, polycarbonate material, or other appropriate materials.

Ribs 52 may be provided on an inside surface of either flange 44 or flange 46, or on both flanges, to aid in providing a good fit to the exhaust conduit 8.

Figure 5:
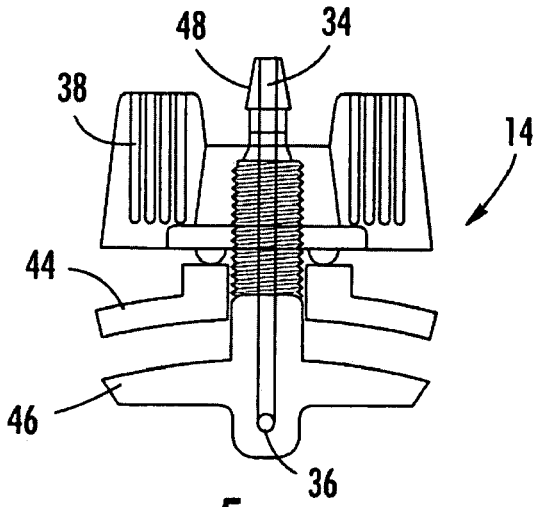
FIG. 5 is a partial cross-sectional view taken along section line 5-5 of FIG. 1.
Figure 10:
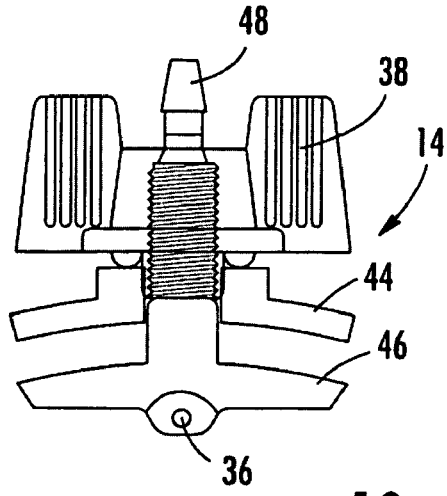
FIG. 10 is another embodiment of the fitting.
Figure 6:
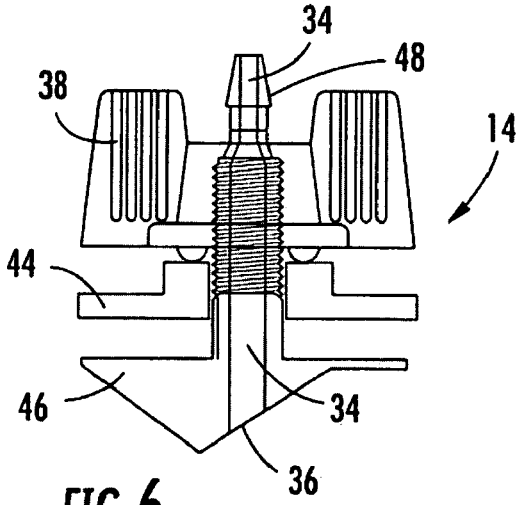
FIG. 6 is a side view of the fitting shown in FIG. 5.
Figure 7:
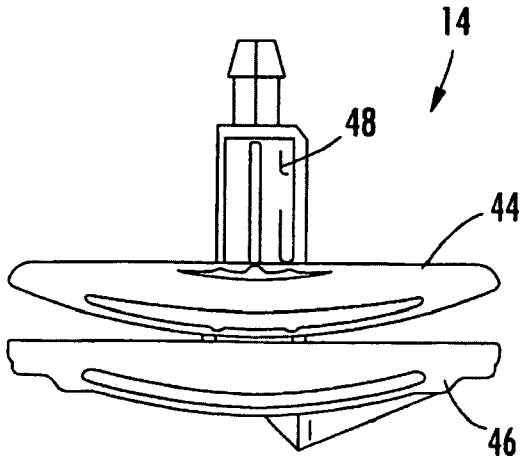
FIG. 7 is perspective view of another embodiment of the fitting shown in FIG. 6.

In one embodiment, as shown in FIGS. 5 and 6, the spigot 48 may be externally threaded and the fitting 14 may include a nut 38 that is threaded to the spigot 48 of the fitting 14 for tightening the flange 44 against an exterior surface of a wall forming the exhaust conduit 8, and against flange 46 which is abutted to the interior surface of the wall forming the exhaust conduit 8. The nut 38 may be a wing nut for easy use without tools, or other appropriate configurations. In another embodiment, as shown in FIGS. 7-9, the flanges 44, 46 are attachable to each other via a snug and secure fit that retains the fitting 14 on the exhaust conduit 8. FIG. 10 discloses another embodiment of the fitting 14 which has a low profile that is less obstructive to the air flow through the exhaust conduit 8.

One or more washers 42, such as foam washers, may be included to create a sufficient seal between the fitting 14 and the exhaust conduit 8. The washer(s) may be provided between flanges 44 and 46, and may be compressed as the flanges 44 and 46 are tightened together.

The fitting 14 may be attached to the exhaust conduit 8 by forming a hole in the conduit and passing flange 46 into an end of the conduit 8 until the spigot 48 may be passed through the hole. Alternatively, spigot 48 may be configured to create a hole in the exhaust conduit 8 by being pressed against the wall forming the conduit 8.

The conduit 16 may connect the fitting 14 in the exhaust conduit 8 with the pressure sensor 18 in the blockage indicator housing 12. The spigot 48 may include a barbed end for attachment of the conduit 16 to the fitting 14. The conduit 16 may have any appropriate size and in one embodiment may be about ⅛ inch inner diameter flexible tubing. It will be appreciated that by providing the electrical components, including the pressure sensor 18, in the blockage indicator housing 12 remote from the fitting 14, the restriction sensor system 10 does not contribute to an increased fire risk. Instead, only air communicates between the fitting 14 and the blockage indicator housing 12.

One or more indicators 20 for indicating that the exhaust conduit 8 has undergone an increase in air pressure that may be caused by, for instance and not by way of limitation, a blockage in exhaust conduit 8 may be positioned in the blockage indicator housing 12. Indicator 20 may emit a visual alert or an audible alert, or both. Indicator 20 may be a light emitting device (LED) or other visually alerting device. The indicator 20 may emit different colored light. For instance, the indicator may be formed from more than one light. In particular, one LED may emit blue light to indicate that the exhaust conduit is not clogged, and another LED may emit red light to indicate that the exhaust conduit is clogged. The blue light may be bright enough to provide nominal light to function as a night light. Indicator 20 may also be a speaker, buzzer, or other noise making device. Indicator 20 may be in communication with the pressure sensor 18. The restriction sensor system 10 may include a testing system that enables the function of the indicator 20 to be tested to ensure that light is emitted from the LEDs and that the audible alert works well. The system may be tested for example, by pushing and holding mute button 32 for at least four seconds.

Restriction sensor system 10 is capable of being installed on any clothes dryer 2 with little modification. The restriction sensor system 10 may be installed on any clothes dryer 2 already manufactured, thereby enabling the clothes dryer 2 to be retrofitted to include the restriction sensor system 10. The clothes dryer may have a tumbler 6 for containing clothes, a heating element for heating air, a fan for blowing air across the clothes in tumbler 6, an exhaust conduit 8 for removing heated air, a control panel 4, and a motor for rotating tumbler 6. The fitting 14 may be coupled to exhaust conduit 8 downstream of the point at which exhaust conduit 8 couples to tumbler 6.

During operation of clothes dryer 2, lint and other debris may be collected with a lint screen. However, lint and other debris often pass through the lint screen and collects in exhaust conduit 8. Accumulation of lint and other debris in exhaust conduit 8 is a fire hazard. When clothes dryer 2 is operating, air pressure increases in exhaust conduit 8. As debris collects in exhaust conduit 8, the air pressure in exhaust conduit 8 further increases. As the air pressure increases, the pressure sensor 18 reacts to the change in air pressure. When the air pressure in exhaust conduit 8 exceeds a threshold pressures, the pressure sensor 18 causes indicator 20 to indicate that exhaust conduit 8 exceeds the threshold pressure. An increase in air pressure in the exhaust system of a clothes dryer may be caused by an increase in lint accumulation.

Indicator 20 may indicate that an air pressure in excess of a threshold air pressure has been observed by producing a blinking or continuous light; or a noise, such as, but not limited to, a buzzer, a beep, a voice that may give instructions on how to check the exhaust conduit, or other noise, or both. In one arrangement, the indicator 20 can light a green LED when the pressure in the exhaust conduit 8 is below a threshold air pressure, and can switch to a red LED if the pressure increases above the threshold air pressure. In another arrangement, the indicator 20 may flash a red LED together with an audible alarm such as "beep, beep" when the threshold air pressure has been exceeded. The audible alarm may be muted by pressing a mute button 38. In one embodiment, after sensor 18 determines that a threshold air pressure has been exceeded, indicator 20 can remain actuated at all times when clothes dryer 2 is in use until the air pressure subsides to a level beneath the threshold air pressure. Alternatively, the indicator can be set to remain activated until reset by a user, as the user may not otherwise notice the indicator light or noise while the clothes dryer is operating. The alarm alerts a user that action needs to be taken to free the exhaust conduit 8 of any lint accumulation. The threshold air pressure will vary depending on numerous factors, such as, but not limited to, the diameter of exhaust conduit 8, the length of exhaust conduit 8, the presence or absence of a cover on the end of exhaust conduit 8 and other factors. As a result, the threshold air pressure may vary.

Figure 11:
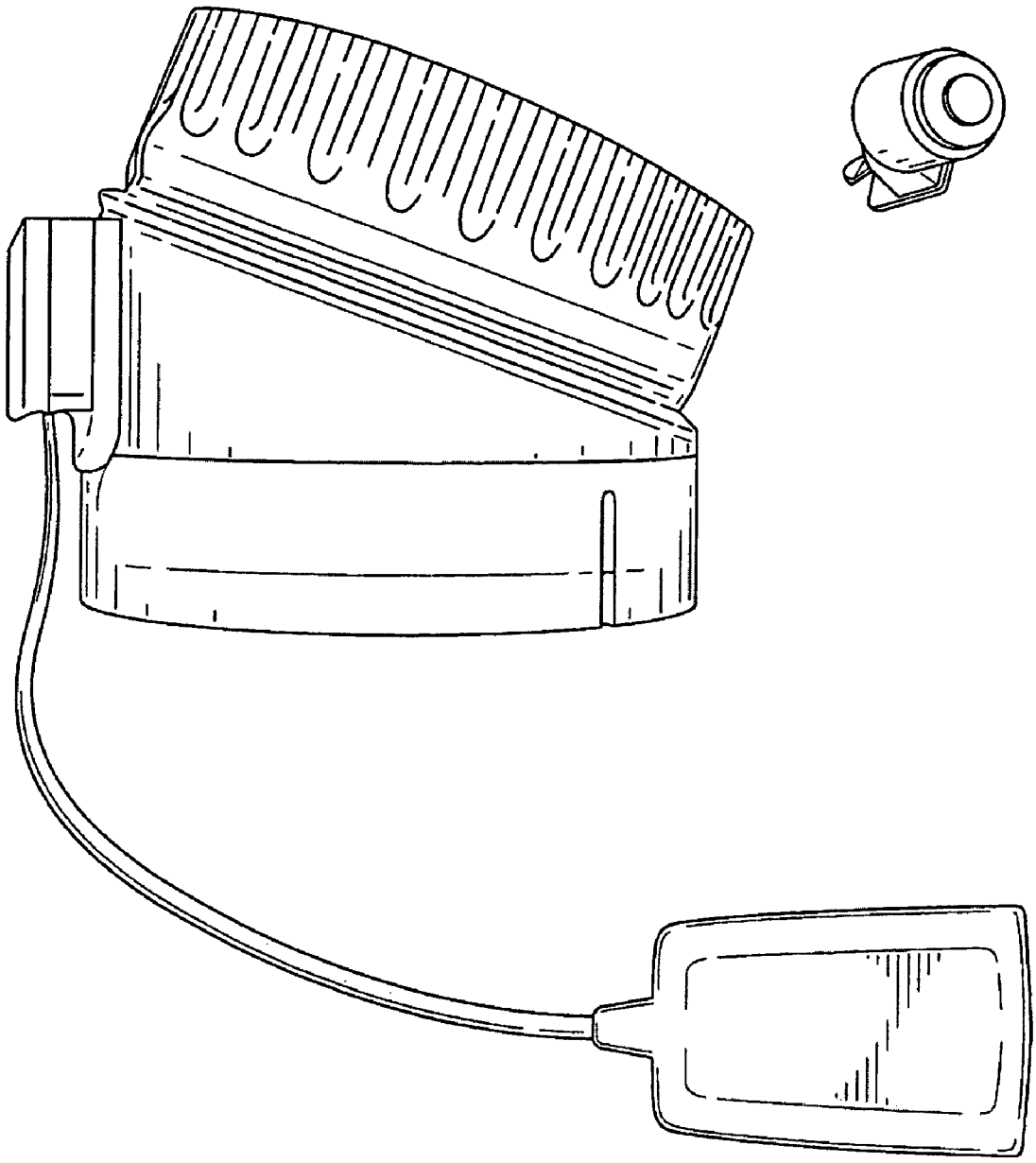
FIG. 11 is another arrangement of a restriction sensor according to the present invention.

In an alternative arrangement, illustrated in FIG. 11, a section of exhaust conduit 60 can be provided, to be placed into an exhaust conduit 8 coming from a dryer 2. The exhaust conduit section 60 may be configured to be placed into an exit of the dryer 2, or at an end of the exhaust conduit 8, or at any suitable point in the exhaust conduit 8 by cutting the exhaust conduit 8 in two and placing the section 60 therein. In this arrangement, a pressure sensor 18 may be attached to the exhaust conduit section 60 instead of being provided in the indicator housing 12. An electrical connection 62 can be provided between the sensor 18 and the indicator housing 12 to carry commands to the indicator 20. In a further alternative arrangement (not shown), the pressure sensor 18 may communicate with the indicator housing 12 wirelessly.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. An air pressure sensing system for a clothes dryer, comprising:

a fitting having at least one cavity therethrough and configured to be coupled to an exhaust conduit of a clothes dryer, the fitting being configured for sampling air passing through the exhaust conduit;

a blockage indicator housing physically remote from the fitting and including at least one chamber;

a pressure sensor contained within the at least one chamber of the blockage indicator housing remote from the fitting, wherein the pressure sensor is in communication with the fitting for sensing pressure changes in the exhaust conduit; and an indicator contained within the blockage indicator housing, wherein the indicator is in communication with the pressure sensor for indicating that the pressure sensor has sensed air pressure exceeding a threshold air pressure in the exhaust conduit.

2. The air pressure sensing system of claim 1, wherein the pressure sensor is a pressure differential switch positioned in the blockage indicator housing for reacting to changes in air pressure in the exhaust conduit.

3. The air pressure sensing system of claim 1, wherein the fitting and the pressure sensor are in fluid communication with each other through a conduit supplying the sampled air from the fitting to the pressure sensor.

4. The air pressure sensing system of claim 1, wherein the indicator contained within the blockage indicator housing is a visual indicator capable of emitting a visual signal.

5. The air pressure sensing system of claim 4, wherein the indicator is a light emitting diode.

6. The air pressure sensing system of claim 1, wherein the indicator contained within the blockage indicator housing is capable of emitting a noise indicating that the exhaust conduit of the clothes dryer has an air pressure greater than a threshold air pressure.

7. The air pressure sensing system of claim 6, wherein the indicator is selected from the group consisting of a buzzer, a beeper and a speaker.

8. The air pressure sensing system of claim 1, wherein the pressure sensor comprises a differential pressure monitoring device.

9. The air pressure sensing system of claim 1, wherein the fitting comprises two curved flanges configured to be coupled to either side of a wall of the exhaust conduit.

10. The air pressure sensing system of claim 9, wherein a first of said flanges comprises a spigot configured to be positioned through a hole in a wall of the exhaust conduit.

11. The air pressure sensing system of claim 10, wherein the spigot is threaded, and wherein a wing nut is provided that can be threaded on to the spigot to hold a second of said flanges onto said first flange.

12. The air pressure sensing system of claim 10, wherein said spigot is barbed to securely receive an air conduit for connecting the fitting to the pressure sensor.

13. The air pressure sensing system of claim 9, wherein the flanges are a snap-fit together.

14. The air pressure sensing system of claim 9, wherein a compressible washer is provided between the flanges.

15. An air pressure sensing system for a clothes dryer, comprising:

a fitting having at least one cavity therethrough and a contamination limiting foil, and coupled to the exhaust conduit of a clothes dryer such that the contamination limiting foil extends into the exhaust conduit, the fitting being configured for sampling air passing through the exhaust conduit;

a blockage indicator housing physically remote from the fitting and including at least one chamber;

a pressure sensor contained within the at least one chamber of the blockage indicator housing remote from the fitting, wherein the pressure sensor is in fluid communication with the fitting via a conduit for sensing pressure changes in the exhaust conduit; and an indicator contained within the blockage indicator housing, wherein the indicator is in communication with the pressure sensor for indicating that the pressure sensor has sensed air pressure exceeding a threshold air pressure in the exhaust conduit;

wherein the indicator contained within the blockage indicator housing includes a visual indicator capable of emitting a visual signal and a sound emitter capable of emitting a noise, indicating that the exhaust conduit of the clothes dryer has an air pressure greater than a threshold air pressure.

16. The air pressure sensing system of claim 15, wherein the visual indicator is a light emitting diode.

17. The air pressure sensing system of claim 15, wherein the indicator is selected from the group consisting of a buzzer, a beeper and a speaker.

* * * * *